US006535118B1

(12) United States Patent
Takagi et al.

(10) Patent No.: US 6,535,118 B1
(45) Date of Patent: Mar. 18, 2003

(54) PRIORITY CONTROLLED NETWORK

(75) Inventors: Masahito Takagi, Cambridge, MA (US); Ichiro Masaki, Boxboro, MA (US)

(73) Assignees: Yokogawa Electric Corporation, Tokyo (JP); Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 10/040,729

(22) Filed: Dec. 29, 2001

(51) Int. Cl.[7] ..... G08B 23/00

(52) U.S. Cl. ..... 340/501; 340/506; 340/3.1; 370/230; 455/428; 600/300; 709/219

(58) Field of Search ..... 340/501, 506, 340/3.1; 370/230; 455/428; 600/300; 709/219

(56) References Cited

U.S. PATENT DOCUMENTS 4,274,087 A * 6/1981 Swanson et al. ..... 340/525
4,803,681 A * 2/1989 Takahashi ..... 370/447
5,260,778 A * 11/1993 Kauffman et al. ..... 725/33
5,267,148 A * 11/1993 Kosaka et al. ..... 705/37
5,377,261 A * 12/1994 Baals et al. ..... 379/201.04
5,710,728 A * 1/1998 Danielson et al. ..... 713/321
5,745,167 A * 4/1998 Kageyu et al. ..... 348/153
6,110,108 A * 8/2000 Shimura et al. ..... 600/300
6,176,826 B1 * 1/2001 Shimura et al. ..... 600/300

* cited by examiner

*Primary Examiner*—Daryl Pope
(74) *Attorney, Agent, or Firm*—Moonray Kojima

(57) ABSTRACT

A priority controlled network wherein a plurality of sensor terminals, at least one display terminal, and control circuit are interconnected by a network, and within each sensor terminal is a priority determining unit to which are supplied data from one or more sensors in the sensor terminal, and parameters controlling the priority determining from the control circuit, whereby priority determining by said priority determining unit is obtained by using said data and said parameters so that a particular priority value is determined for each of the plurality of sensor terminals and selected priority value data are displayed in the at least one display terminal and capacity of said network is optimally used where more than one display terminal is provided.

18 Claims, 2 Drawing Sheets

PRIORITY CONTROLLED NETWORK

BACKGROUND OF THE INVENTION

1. Field of Invention

This invention relates to a priority controlled network, wherein a plurality of sensor terminals and at least one display terminal are connected to a network and priority of data from the plurality of sensor terminals to the network are selectively displayed on the at least one display terminal.

2. Discussion of the Prior Art

In a conventional surveillance system using a plurality of TV cameras, at least one display unit, and a network connecting the cameras and display unit, the problem of limited capacity of the network can be troublesome. For example, an operator might not recognize an emergency situation since he cannot simultaneously view all of the iamge data from all the cameras. Also, the total amount of data can readily exceed the capacity of the network so that priority of data is difficult to maintain. Improvement is needed to enable more efficient and reliable use of networks and display of data based on a predetermined priority value.

A conventional network is known which uses a plurality of sensor terminals, such as TV cameras, connected to a network. Each sensor terminal determines the priority of its data. Where the network has a certain capacity, for example, 10 image data, and the number of sensors exceeds the capacity, it has been suggested that the sensor terminal having the least valuable priority, such as the 10th, stop transmitting if it has less than the 10th value priority. Although, such suggested system may solve the immediate problem, there is the disadvantage that the number of sensors at each terminal is fixed, and hence, flexibility of design is reduced.

SUMMARY OF THE INVENTION

Accordingly, an object of the invention is to overcome the aforementioned and other deficiencies, disadvantages and problems of the prior art.

Another object is to provide a priority controlled network, such as used for visual surveillance systems, wherein a selective priority method enables expansion of the priority capacity of the network, and increase flexibility of design.

The foregoing and other objects are attained by the invention, which encompasses a priority controlled network, wherein one or more parameters used at a sensor terminal is supplied to determine priority value and are varied so that priority data are determined by the varied parameters and the sensor terminals having the desired priority values are selected in a network having a capacity of the highest priority value. For example, a network having a capacity of 10 sensors can have more than 10 sensors when the priority values are determined for 10 values of the more than 10 sensors.

The foregoing procedure is applied to a plurality of sensor terminals, at least one display terminal, and control unit interconnected to a network, wherein the control unit supplies the parameters, such as priority calculation algorithm and priority calculation equations, and priority value determination is made by a priority calculation unit in the sensor terminals.

DETAILED DESCRIPTION OF THE PREFERRED EMBODIMENTS

Figure 1:
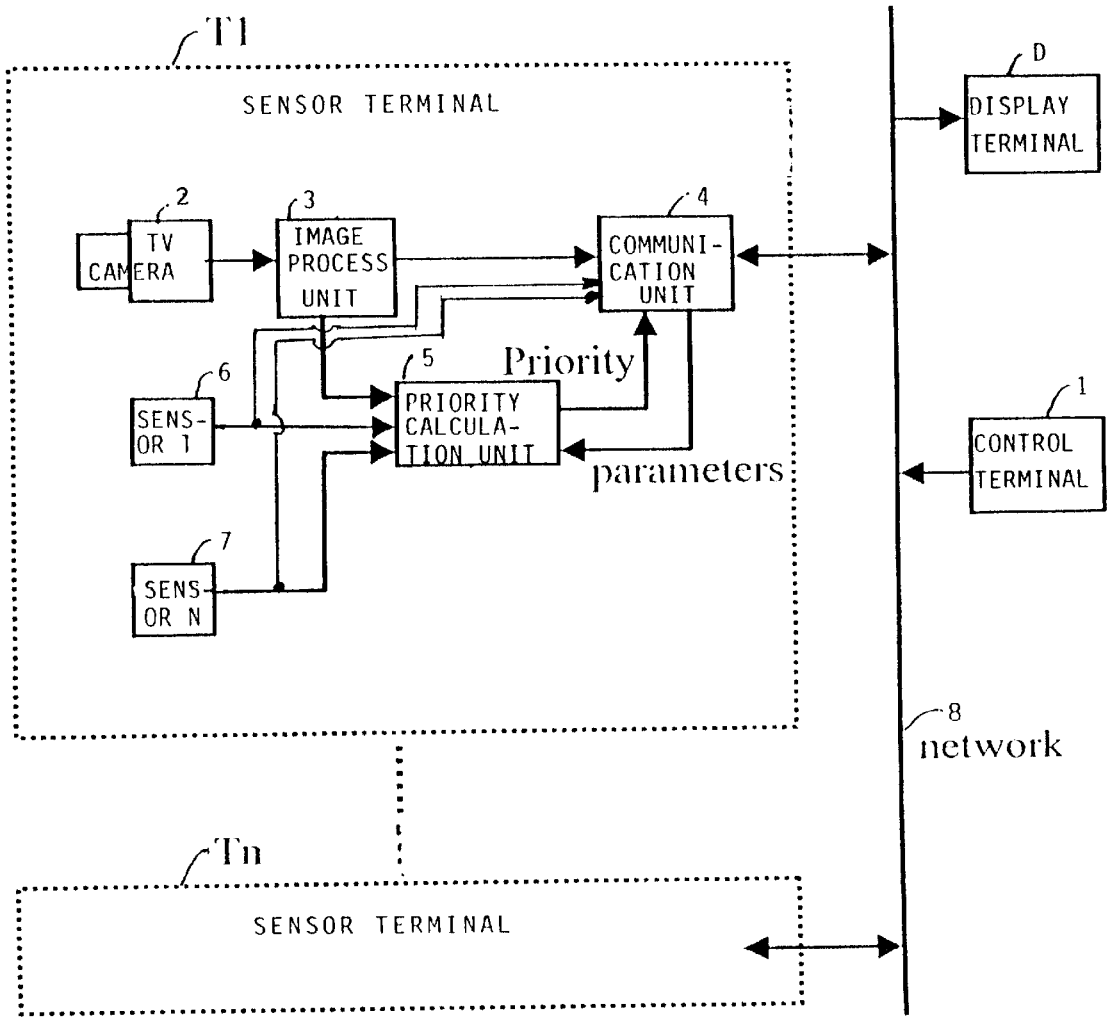
FIG. 1 is a block diagram depicting an illustrative embodiment of the priority controlled network of the invention, showing details of the sensor terminals, and one display terminal and using a control terminal as a part of the control means.

FIG. 1 shows a priority controlled network including a network 8 interconnecting a plurality of sensor terminals T1 . . . Tn, one display terminal D, and a control unit having a control terminal 1, therein. Details of the sensor terminal, e.g. T1, are shown and are explained below.

Figure 2:
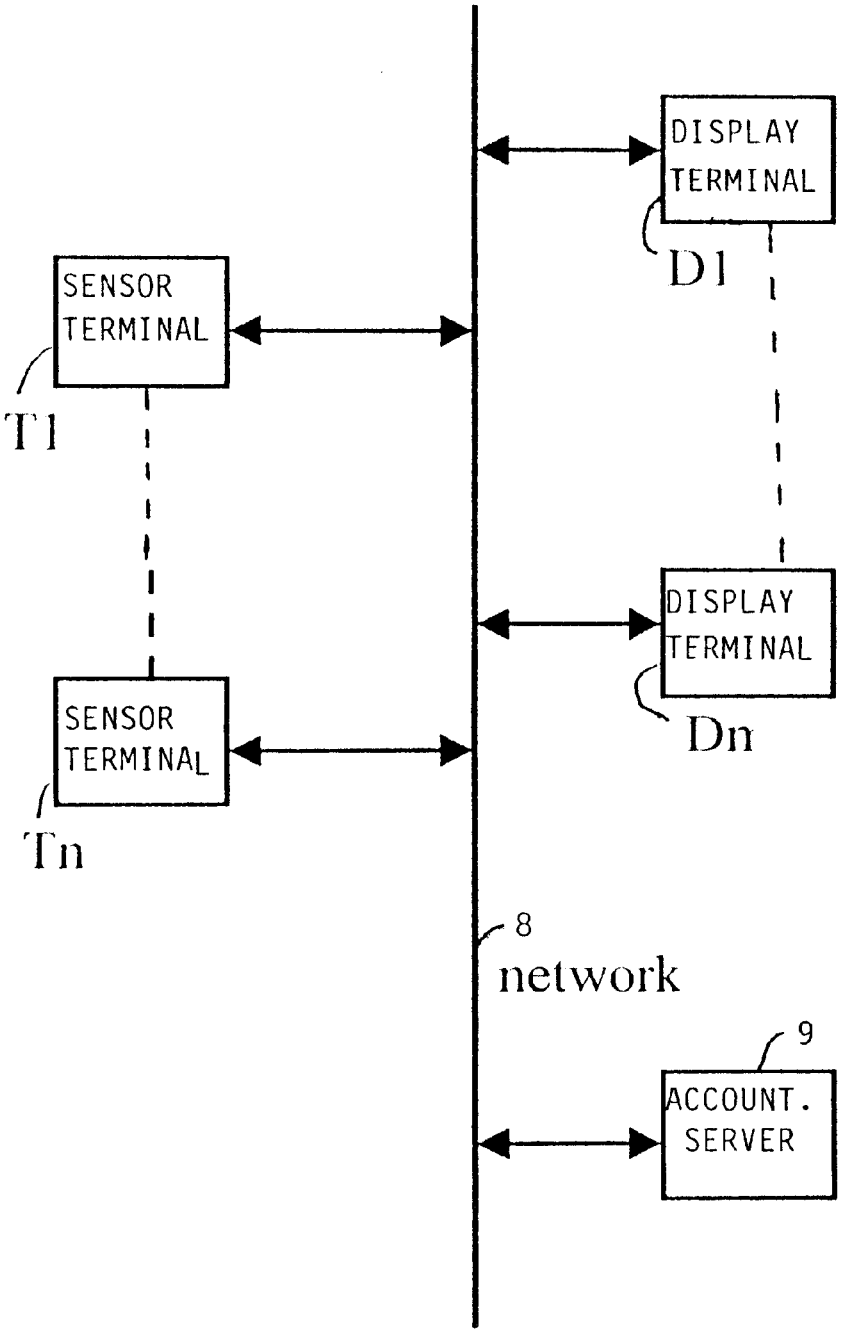
FIG. 2 is a block diagram depicting the illustrative embodiment of the priority controlled network of the invention, showing a plurality of display terminals and using an accounting server as a part of the control means.

FIG. 2 shows a similar controlled network, except that instead of one display terminal D, a plurality of display terminals D1 . . . Dn are shown. The control unit is shown having an accounting sensor 9, therein.

As shown in FIG. 1, each of the sensor terminals T1 . . . Tn comprises a TV (e.g. a closed circuit television) camera 2, connected to an image processing unit 3, which is connected to priority calculation unit 5 and to communication unit 4. Sensors 1 . . . N (labeled 6,7) are connected to and provide input to the priority calculation unit 5. The priority calculation unit 5 is connected to the communication unit 5 to receive parameters sent from control terminal 1 through network 8 and through communication unit 4, and to supply priority signals, such as priority value, to communication unit 4. Thus, the priority calculation unit 5 receives data from camera 2, through image processing unit 3, and data from each of sensors 6 and 7, and parameters from communication unit 4. After calculation using the parameters from communication unit 4 and the data from camera 2 and sensors 6 and 7, a priority signal, such as priority value, is supplied to communication unit 4, to enable suitable transmission through network 8 to the appropriate single display terminal D (in FIG. 1) or to the plurality of display terminals D1 . . . Dn (in FIG. 2). Sensors 6 and 7 area connected directly to unit 4 for desired use.

As constituted, the visual image from TV camera 2 is supplied through image processing unit 3 to the communication unit 4 for display in the appropriate display terminal D1 . . . Dn as governed by the priority value calculated for that sensor terminal. The data from the camera 2 is also processed by processing unit 3 and supplied to the priority calculation unit, so that together with data from sensors 6 and 7, and using the parameters supplied by the communication unit 4, the priority calculation unit 5 can make the desired priority calculation, and provide a priority signal, such as priority value. Advantageously, the data from a plurality of sensors, such as camera 2, and sensors 6,7, and through the parameters sent from the control unit 1, the conditions of all of the sensor terminals can be taken into consideration when assigning priority values.

Connected to the network is the control unit 1 having therein a control terminal 1, which supplies parameters to the communication unit 4 through network 8, and then to the priority calculation unit 5 of each of the plurality of sensor terminals T1 . . . Tn. The parameters sent by control unit 1, may comprise a priority calculation algorithm and one or more priority calculation operations. The parameters may include conditions of each of the sensor terminals T1 . . . Tn and the various sensors therein. The control unit 1 continues to monitor conditions of the entire network and the components thereof, and takes these conditions into consideration when providing the parameters to each different sensor terminal. The priority calculation unit 5 comprises a computer and in the calculation process uses such algorithms and operations. When the priority signal is sent to the calculation unit 5, the priority value is assigned thereto so that in the desired order of priority, the visual images from camera 2 of the desired sensor terminals are displayed in the desired display terminals D1 . . . Dn.

The sensors 1 . . . N (labeled 6 and 7) may be any desired sensor, such as a temperature sensor to measure air temperature, a microphone to sense and transmit sound, etc. The sensor 6, and 7 and TV camera may be located at a fixed location or may be disposed to be movable from one location to another location. Also, the display terminals may be located at a fixed location, or may be located at different positions. For example, the TV cameras and sensors 6 and 7 may be disposed in fixed locations, such as besides a road, and form part of a road surveillance system for recording traffic accidents. Similarly, the air temperature sensor and/or microphones can be fixed at the same location as the TV camera, or may be disposed at different locations. When the camera, for example, are used, they may be placed in different road side locations, such as one mile apart and cover a certain area. In the same manner, the air temperature sensor and/or microphones can be placed periodically apart along the road for optimal coverage. The display terminal, being real time visual, can be advantageously used to observe a real time event. Thus, the one or more display terminals can be located at the same location or be at different locations, as desired.

The visual images from camera 2 can also be stored in the image processing unit 3 or in the communication unit 4, with use of a storage unit in such image processing unit 3 and/or communication unit 4. In this manner, the stored images can be used later as desired, such as for research into causes of vehicle accidents.

When there is only one display terminal D (see FIG. 1), the display will display the highest priority value data, or depending on the algorith and equations of the parameters supplied by control unit 1, the single display D may display the data having a certain priority value,which is not necessarily the highest priority value.

On the other hand, where there are a plurality of display terminals D1 . . . Dn (as shown in FIG. 2), each of the different display terminals D1 . . . Dn will display data having a priority value within a range of priority values assigned to the plurality of display terminals. For example, when there are signlas having priority 1 through 10, and there are 10 display terminals and 10 sensors, all of the data wil be displayed. However, if there are more than 10 sensors, such as 15 sensors, and only 10 display terminals, then the sensor terminals having the priority values assigned thereto of 1–10 will be shown in the display terminal. By suitable algorithm and equations, in a suitable control signal from control unit 1, the data having less valued priority can also be continuously shown in the display terminals 1–10. For example, every "M" minutes, a different set of images can be shown in displays 1–10, but from sensor terminals having assigned priority values 2–11, then next 3–12, then next 4–13, etc. In another embodiment, the images from terminals having priority 5–15, instead of 1–10, can be shown. Thus, with the invention flexibility is obtained, and desired priority is obtained at all times. Also, the images for all sensors can be displayed even though the capacity of the network is limited.

The display terminals may comprise a visual display unit, such as a television monitor, and also comprise appropriate data servers and database, minicomputers and-storage units to perform desired functions. Also, the plurality of sensor terminals may comprise a data server, database, minicomputers and storage unit to enhance the carrying out of the foregoing method.

The control terminal 1 is understood to be a control unit and can comprise a control terminal 1(see FIG. 1) and/or an accounting server 9 (see FIG. 2). They have been labeled as shown in FIGS. 1 and 2 for sake of convenience of description. Also, only one display terminal D is shown in FIG. 1 and a plurality of display terminals are shown in FIG. 2 for sake of convenience of description.

When only one display terminal D (in FIG. 1) is used then the control terminal 1 sends to all sensor terminals T1 . . . Tn, priority calculation algorithm and equations so that a highest (or other desired priority rank) priority is calculated by the priority calculation unit 5 using the data from the various sensors for one particular sensor terminal and the visual images from the camera 2 therefrom will be caused to be shown on the one display terminal.

On the other hand, using a plurality of sensors and a plurality of display terminals (see FIG. 2), the control unit 1 having an accounting server therein 9 , will provide suitable priority calculation algorithm and equations, for example as "parameters" so that the priority values of the different sensor terminals will cause assignment of the different images from the different sensor terminals to be displayed on the display terminal assigned to that display terminal.

In using an accounting server 9, as part of the control unit, priority values can be calculated based on fees charged to the different sensor terminals. Thus, for example, based on relative financial values of the different sensor terminals, the priority values can be calculated for each sensor terminal so that commerically, the highest payer will obtain best service in terms. of display on the display terminal. Also, the accounting server can concurrently work up charges for the different sensor terminals reflecting the priority order of displaying.

Advantageously, the capacity of the network can thus be fully utilized continually and concurrently therewith all of the desired data can be displayed in order of priority value. Teh parameters sent by the control unit 1 to the one or more sensor terminals can control the priority of the data, such as visual images from camera 2, which is obtained in one or more sensor terminals, and the display of the image of a particular priority value in the one or more display terminals. Also, advantageously, the various elements shown in the drawing and/or discussed in the specification, such as servers, TV cameras, sensor terminals, display terminals, image processing unit, priority calculation unit, sensors, communication unit, control terminal, accounting server, etc, are of circuit components known in the art and can be readily obtained and understood from the description herein.

The foregoing description is illustrative of the principles of the invention. Numerous modifications and extensions thereof would be apparent to the worker skilled in the art. All such modifications and extensions are to be considered to be within the spirit and scope of the invention.

What is claimed is:

1. A priority controlled network comprising:

a plurality of sensor terminals;

at least one display terminal;

control means for providing control signals to said plurality of sensor terminals and/or at least one display terminal; and a network interconnecting said plurality of sensor terminals, said at least one display terminal, and said control means;

wherein each of said plurality of sensor terminals comprises:

at least one sensor for providing data;

processing means for generating an output signal from said data from said at least one sensor and for generating another data signal;

priority calculating means for calculating and providing a priority signal of a particular value using said control signals from said control means and data from said at least one sensor and said another data signal from said processing means; and communication connected to said network for transmitting said output signal from said processing means and/or data from said at least one sensor to said at least one display terminal when said priority calculation means provides said priority signal of a particular value, so that priority of said data represented by said output signal will be transmitted within capacity of said network regardless of which of said plurality of sensor terminals are within a priority value, said communication means also receiving said control signals from said control means through said network and transmitting said control signals to said priority calculating means.

2. The network of claim 1, further comprising a plurality of display terminals for displaying maximum priority data and other priority data in different ones of said plurality of display terminals.

3. The network of claim 1, wherein said control means comprises a control terminal for sending as control signals a plurality of parameters, said parameters comprising priority calculating algorithm and priority calculating operations.

4. The network of claim 1, wherein said control means comprises an accounting server connected to said network for providing output signals which determine priority value of each of said plurality of sensor terminals using financial values assigned to each of said plurality of sensor terminals.

5. The network of claim 4, wherein said accounting server also provides for charging of each of said plurality of sensor terminals for information and content of data being displayed.

6. The network of claim 1, further comprising a plurality of display terminals connected to said network for displaying data from said plurality of sensor terminals and being assigned a value of priority for each of said plurality of display terminals.

7. The network of claim 6, wherein said plurality of sensor terminals are numbered "N" and the top "IN" value of priority data are received and displayed in said plurality of display terminals.

8. The network of claim 6, wherein said control means comprises server means for permitting a number of display terminals to receive displaying data on display terminals for a maximum priority value-and lower priority value consistant with number of dispplay terminals.

9. The network of claim 1, wherein said network comprises a hard wire network.

10. The network of claim 1, wherein said network comprises a wireless network.

11. The network of claim 6, wherein said plurality of sensor terminals, said plurality of display terminals, and said control means are disposed at fixed locations.

12. The network of claim 6, wherein said plurality of sensor terminals, said plurality of display terminals, and said control means are disposed at movable positions.

13. The network of claim 6, wherein said plurality of display terminals each comprises a data server and database.

14. The network of claim 1, wherein said plurality of sensor terminals each comprises a data server and a database.

15. The network of claim 1, wherein said control means comprises a data server and a database.

16. The network of claim 6, wherein said plurality of display terminals comprise means for offering financial value to said control means and wherein said control means comprises means for permitting top M display terminals to receive display data on said plurality of display terminals by an auction.

17. The network of claim 16, wherein said control means further comprises means for charging each of said plurality of display terminals which are permitted to receive display data on said top M display terminals.

18. The network of claim 6, wherein said control means further comprises accounting server device connected to said network for charging each of said plurality of display terminals using financial values assigned to each of said plurality of display terminals.

* * * * *